US007760169B2

(12) United States Patent
Giraldo et al.

(10) Patent No.: US 7,760,169 B2
(45) Date of Patent: Jul. 20, 2010

(54) DISPLAY DEVICE

(75) Inventors: Andrea Giraldo, Eindhoven (NL); Mark Thomas Johnson, Eindhoven (NL); William Peter Mechtildis Marie Jans, Eindoven (NL); Remco Los, Arequipa (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 221 days.

(21) Appl. No.: 10/551,023

(22) PCT Filed: Mar. 29, 2004

(86) PCT No.: PCT/IB2004/050356

§ 371 (c)(1),
(2), (4) Date: Sep. 29, 2005

(87) PCT Pub. No.: WO2004/088568

PCT Pub. Date: Oct. 14, 2004

(65) Prior Publication Data

US 2006/0250334 A1 Nov. 9, 2006

(30) Foreign Application Priority Data

Apr. 4, 2003 (EP) ..... 03100906

(51) Int. Cl.
*G09G 3/32* (2006.01)

(52) U.S. Cl. ..... 345/82; 345/76

(58) Field of Classification Search ..... 340/780; 356/432; 358/230

See application file for complete search history.

(56) References Cited

U.S. PATENT DOCUMENTS

| | | | | |
|---|---|---|---|---|
| 4,021,607 | A * | 5/1977 | Amano | 348/800 |
| 4,771,278 | A * | 9/1988 | Pooley | 345/73 |
| 5,652,600 | A * | 7/1997 | Khormaei et al. | 345/76 |
| 6,281,686 | B1 * | 8/2001 | Hawkins, Sr. | 324/555 |
| 6,281,868 | B1 | 8/2001 | Takeuchi et al. | |
| 6,288,695 | B1 * | 9/2001 | Wood | 345/75.2 |
| 6,567,171 | B1 * | 5/2003 | Rushing | 356/432 |
| 7,119,773 | B2 * | 10/2006 | Kim | 345/89 |
| 2002/0130893 | A1 * | 9/2002 | Okuda | 345/691 |

FOREIGN PATENT DOCUMENTS

| | | | |
|---|---|---|---|
| WO | 03001813 | A1 | 1/2003 |
| WO | 2003046878 | A1 | 6/2003 |

OTHER PUBLICATIONS

Shaozhan Xiong, et al: 42.1: A Novel Design of Sub-Frame and Current Driving Method for PM-OLED, May 2002, SID pp. 1174-1177, XP001134336.

* cited by examiner

*Primary Examiner*—Amare Mengistu
*Assistant Examiner*—Jennifer Zubajlo

(57) ABSTRACT

The display device (6) comprises a display (2) and generating means (10,8). The display (2) has a plurality of light emitting elements (3), and data lines (13) for providing pulse width modulation (PWM) signals to the light emitting elements (3). The generating means (10, 8) are coupled to the data lines (13) for generating, during time intervals (SF) of a frame period, at least a first non-zero emission level (L(V1; C1; I1)) of a light emitting element (3) during a first one of the time intervals (SF) and a second non-zero emission level (L(V2; C2; 12)) during a second one of the time intervals (SF).

14 Claims, 11 Drawing Sheets

DISPLAY DEVICE

The invention relates to a display device comprising a display with a plurality of light emitting elements. The invention also relates to an electric device comprising such a display device and to a method of driving a display.

Display devices employing light emitting elements or pixels on or over a substrate are becoming increasingly popular. These light emitting elements may be light emitting diodes (LEDs) incorporated in or forming display pixels that are arranged in a matrix of rows and columns. The materials employed in such LEDs are suitable to generate light if a current is conveyed through these materials, such as in particular polymeric (PLED) or organic (OLED) materials. Accordingly the LEDs have to be arranged such that a current can be driven through these light emitting materials. Typically, passively and actively driven matrix displays are distinguished. For active matrix displays, the display pixels themselves comprise active circuitry such as one or more transistors.

In active matrix displays the variation of the parameters of the transistors is an important issue for e.g. the uniformity of the display. By operating the transistors at a reasonably high current the light emission of the LEDs is less sensitive to variations in the threshold voltage of the transistors, the variation of which has been recognized as a major cause of non-uniformity of the display. If the LED operates with only a few levels of brightness, each of them corresponding to a specific level of current, such an operating scheme is called digital driving.

Since by digital driving only a few levels of brightness are available, as is well known, more gray levels may be made by using pulse width modulation (PWM). For example, the light emitting elements of the display may be either turned "on" or "off" during any of a number of subfields in a frame period, in dependence on a desired gray level. The subfields are time intervals within a frame period.

However, when applying row at a time addressing for large displays comprising a high number of selection lines associated with rows of light emitting elements, the available addressing time for addressing or selecting one row may be in the order of sub-microseconds. In order to deal with these very short addressing times a multiline addressing (MLA) scheme is preferable. The MLA scheme is sometimes also referred to as a combined line or row addressing approach. In an MLA scheme dead times between the subfields are minimized by proper algorithms. Such an approach is e.g. disclosed in EP application no. 01204541.5. In the present text MLA is considered to be a species of PWM addressing, i.e. PWM includes MLA.

A problem of PWM techniques is that they do not provide an optimal range of gray scale levels for a display.

It is an object of the invention to significantly enhance the number of gray scale levels of PWM addressed displays.

This object is achieved by providing a display device comprising:

a display with a plurality of light emitting elements, and data lines for providing pulse width modulation (PWM) signals to the light emitting elements; and means coupled to the data lines for generating, during time intervals of a frame period at least a first non-zero emission level of a light emitting element during a first one of the time intervals and a second non-zero emission level during a second one of the time intervals.

Next to the first and second non-zero level, a zero level and additional non-zero levels may be present.

Rather than increasing the time interval when a subfield with a larger weight is required, a second emission level higher than the first emission level should be employed that allows to generate a subfield of a larger weight to be generated without increasing the time interval.

As the duration of a subfield is shortened in this way, more subfields may be generated during a frame period, resulting in an enhanced number of gray scale levels for the display. The generating means may comprise a data driver and a control unit for receiving information about an image to be displayed and for determining drive signals and timing signals for driving the data driver. The display is preferably an active matrix display. Such a display allows a part of the plurality of light emitting elements to emit light, while another part is being addressed or erased. This is made possible because each of the light emitting elements includes an active element, such as a thin film transistor in combination with a memory element, for example, a capacitor. The matrix display may be an organic LED or a polymeric LED display.

In an embodiment a multiline addressing scheme is applied, which results in a further reduction of dead time within a frame period, thereby allowing for more time intervals for generating light, and hence enabling more gray levels to be generated.

The generating means may also comprise a row selection circuit for selecting a part of the plurality of light emitting elements.

Preferably the time intervals of the PWM addressing scheme have a binary weighted duration. These time intervals may be arranged in mixed up order with respect to their duration, i.e. time intervals of long and short duration may be adjacent to each other in order to achieve an optimal use of the frame period. Preferably, each of the emission levels is associated with a set of time intervals having a binary weighted duration.

In an embodiment of the invention the emission levels of the light emitting elements are provided via the data lines. Preferably, this is done in a sequential mode wherein during a frame period first all time intervals are processed sequentially for the first emission level and subsequently for the second emission level etc. This driving scheme is suitable for both voltage programmed and current programmed light emitting elements.

In the intermixed mode, time intervals associated with the emission levels may be distributed within the frame period as desired, for example, the first emission level and the second emission level are employed alternately for each time interval. This driving scheme is suitable for both voltage programmed and current programmed light emitting elements. For current programmed light emitting elements it is preferred in this embodiment to employ several independent current sources, since the emission level of the light emitting element may change frequently within a frame period. In such a case a single current source is less suitable, since current sources are generally not able to switch sufficiently precisely between various current magnitudes within a short time.

For current programmable light emitting elements it may be advantageous to bring the data line at a suitable voltage level before applying the current in order to overcome delays due to parasitic capacitances in the data lines.

The driving scheme using a power line to couple a first or a second supply voltage to the light emitting elements is particularly suitable for voltage programmed light emitting elements.

The invention further relates to an electric device comprising a display device as described in the previous paragraphs. Such an electric device may relate to handheld devices such as a mobile phone, a Personal Digital Assistant (PDA) or a portable computer as well as to devices such as a Personal Computer, a computer monitor, a television set or a display on e.g. a dashboard of a car.

The invention will be further illustrated with reference to the attached drawings, which show preferred embodiments according to the invention. It will be understood that the device and method according to the invention are not in any way restricted to these specific and preferred embodiments. In the drawings.

Figure 1:
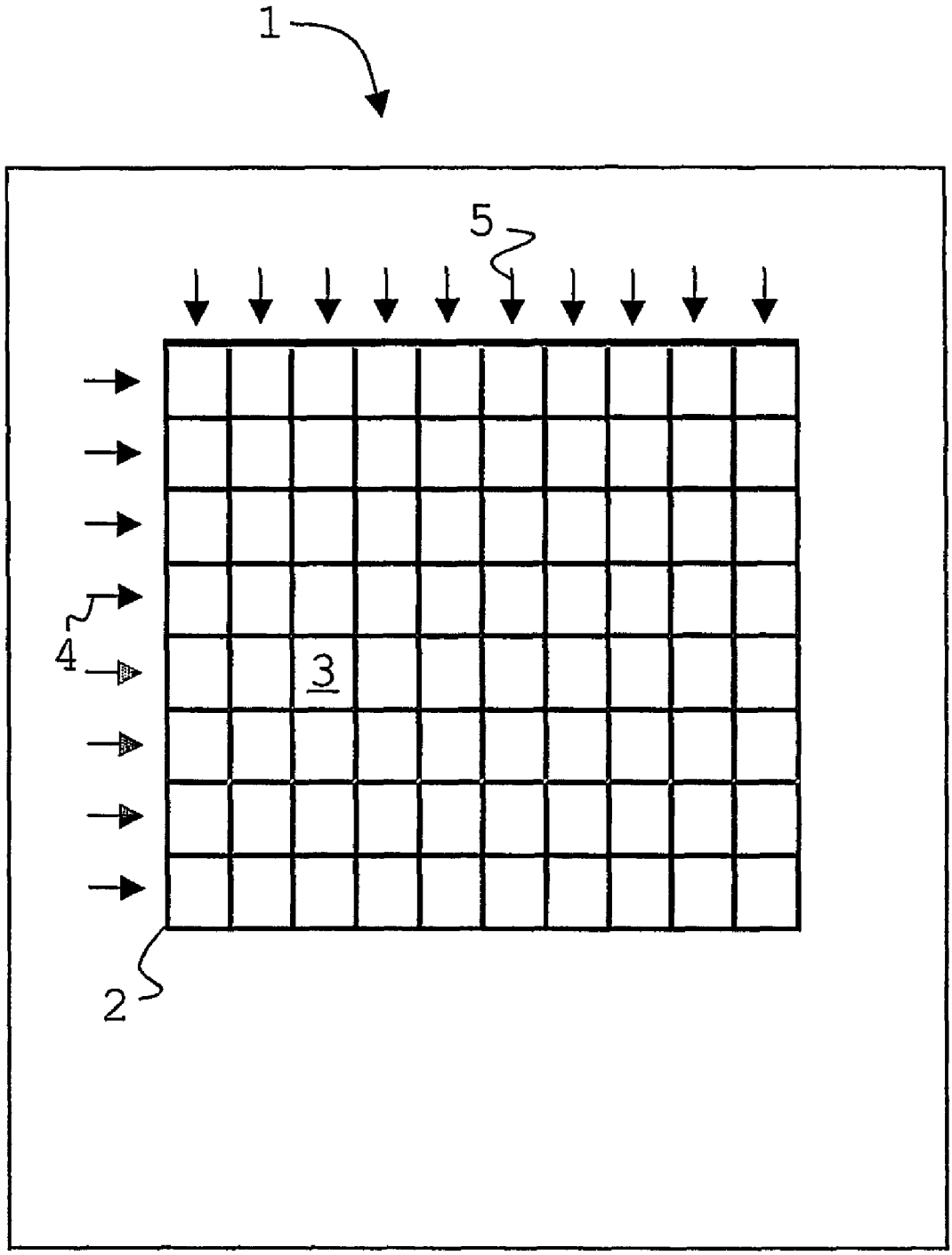
FIG. 1 shows an electric device comprising a display according to an embodiment of the invention.

FIG. 1 shows an electric device 1 comprising a display 2 having a plurality of light emitting elements or display pixels 3 arranged in a matrix of rows 4 and columns 5.

Figure 2:
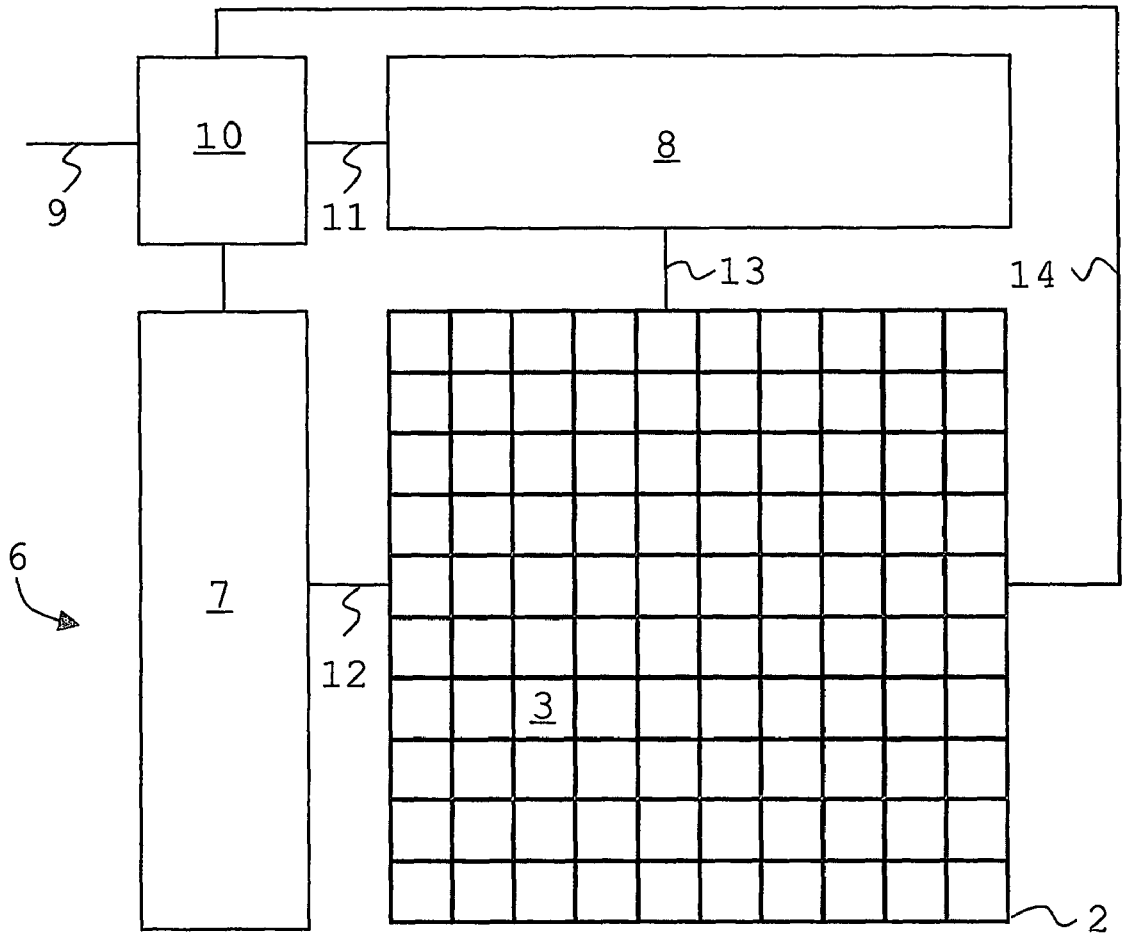
FIG. 2 shows a display device for an active matrix display according to an embodiment of the invention.

FIG. 2 shows a schematic illustration of a display device 6, comprising the display 2 of the electric device 1 as shown in FIG. 1. The display 2 comprises a row selection circuit 7 and a data driver 8. Information or data, such as (video) images, received via line 9 and to be presented on the display 2 is input to the control unit 10, which information or data is subsequently transmitted by the control unit 10 to the appropriate parts of the data driver 8 via line 11. The selection of the rows 4 of the display pixels 3 is performed by the row selection circuit 7 via selection lines 12. Data are written to the display pixels 3 from the data driver 8 via data lines 13.

Moreover the control unit 10 controls the power supply of the display pixels 3 via power lines 14.

Figure 3:
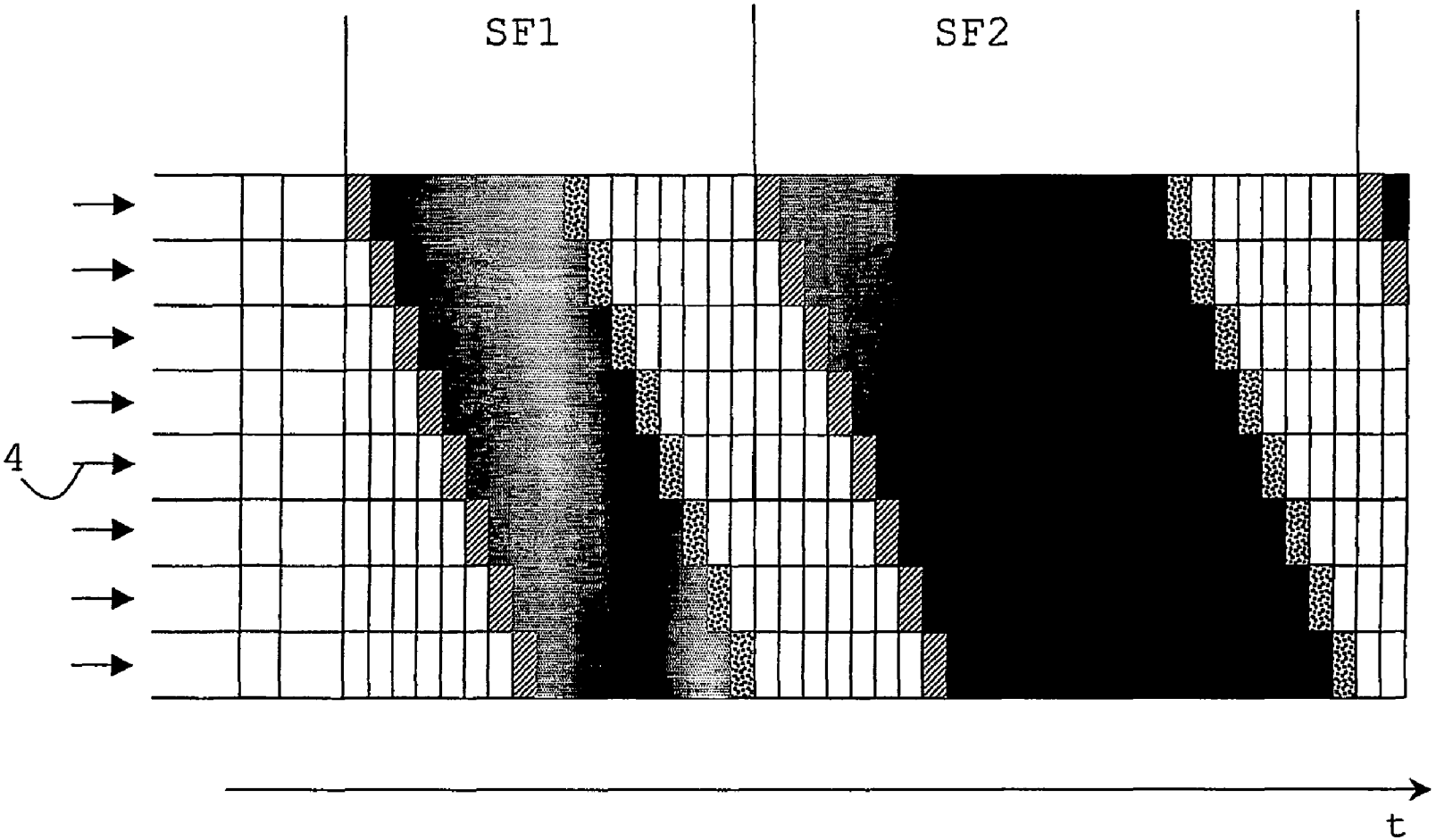
FIG. 3 shows a schematical timing diagram representing pulse width modulation (PWM) according to the prior art.

FIG. 3 displays a timing diagram illustrative of pulse width modulation (PWM for forming gray scale levels in display technologies. In FIG. 3 only eight rows 4 of the display 2 are shown in the vertical direction, while in the horizontal direction the state of each row as a function of time t is shown. Only a fraction of a frame period is shown. The frame period is divided into subfields or time intervals SF of different duration in accordance with the number of gray scale levels to be displayed. FIG. 3 only shows two time intervals or subfields, indicated by SF1 and SF2, of the frame period for the eight rows 4. In the time intervals SF several states can be distinguished for the display pixels 3, viz, addressing (hatched blocks), burning (black blocks), erasing (dotted blocks) and dead time (white blocks). If the time intervals SF of the frame period have a binary weighted distribution, the time intervals represent a bit representation of the number of gray scale levels. E.g. if the frame period is divided into 6 binary weighted time intervals SF1 . . . 6, SF1 represents gray scale bit level 1, SF2 gray scale bit level 2, SF3 4, SF4 8, SF5 16 and SF6 32, which results in $2^6$=64 possible gray scale levels (=6-bit) in total.

For a display 2 comprising 480 rows 4, a frame time of 20 ms, with 64 gray scale levels results in an available time interval of 0.65 microseconds for subfield SF1.

Figure 4:
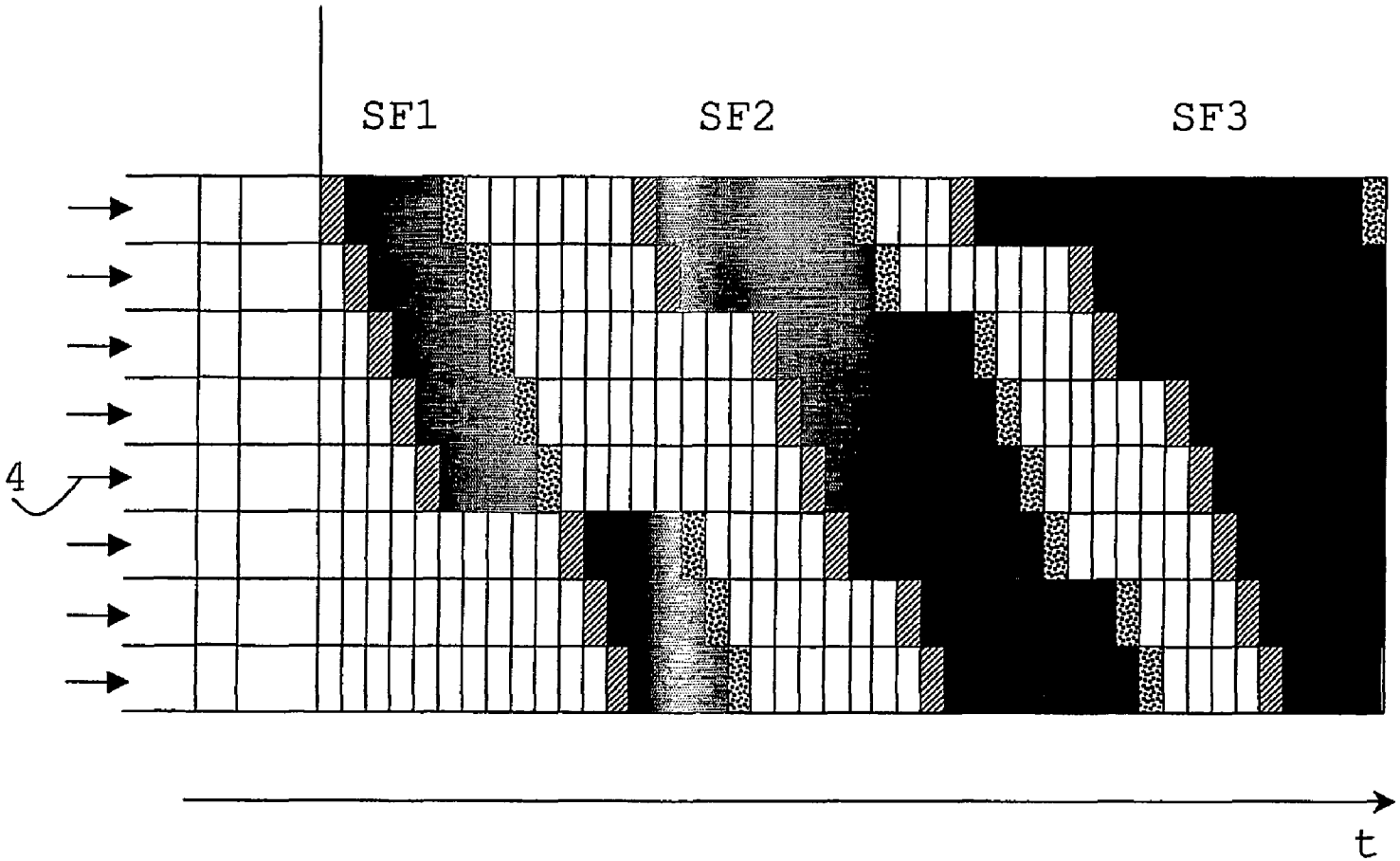
FIG. 4 shows a schematical timing diagram representing pulse width modulation employing an MLA scheme according to the prior art.

FIG. 4 displays a timing diagram employing multiline row addressing (MLA) in combination with PWM. As can be clearly observed, in MLA the amount of dead times between the time intervals SF and for the rows 4 is variable and can be minimized by applying proper algorithms. As a result the available time in the frame period is used more efficiently. It is noted that it may be preferred to shuffle or mix up the time intervals within the frame period in order to obtain the most efficient result. This means that in the example of the previous paragraph the sequence of time intervals is not necessarily SF1, SF2, SF3, SF4, SF5, SFA6, but e.g. SF3, SF1, SF6, SF4, SF2, SF5.

Figure 5:
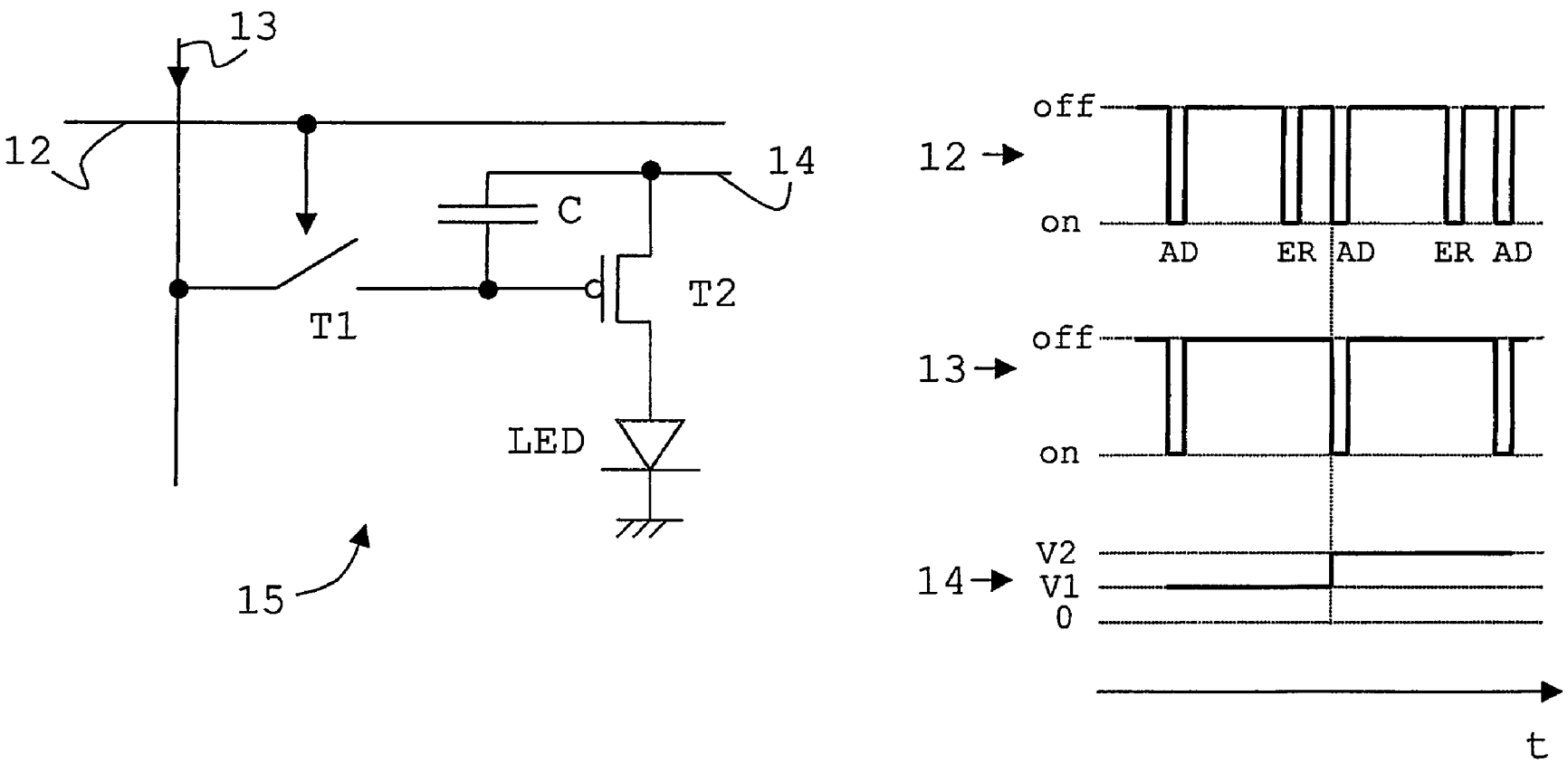
FIG. 5 shows a first embodiment of the invention in a voltage programmed pixel circuit employing multilevel power addressing (MPA) in the intermixed mode.

FIG. 5 shows a first embodiment of the invention in a voltage programmed pixel circuit 15. Only a single display pixel 3 of the display 2 is shown, comprising transistors T1 (drawn as a switch) and T2, a capacitor C and a LED. Display pixel 3 can be selected via selection line 12 and provided with data via data line 13. The display pixel 3 is powered via power line 14. The selection signals provided over the selection line 12 are represented in the right-hand diagram, wherein the on state refers sequentially to addressing AD and erasing ER. The data provided over the data line 13 is a voltage that is able to either fully open or fully close the transistor T2, represented by "off" and "on" in the right-hand diagram, i.e. T2 behaves as a switch and the light emission level of the LED is dependent on the supplied voltage over the power line 14. Different voltages give rise to different emission levels of the LED. This effect is used to enhance the number of gray scale levels within a frame time. In FIG. 5 PWM-signals are supplied to the display pixel 3 via selection line 12, during the first time interval SF1 the display pixel 3 being brought first in a first emission state (corresponding to the first emission level), indicated by V1, and in a subsequent time interval SF1 of the same duration in a second emission state (corresponding to the second emission level), indicated by V2. This is shown in the right-hand diagram. These events can be repeated (not shown) in the next time interval SF2, wherein burning is subsequently performed at V1 and V2 again within the time interval SF2. If n power levels are available over power line 14, i.e. multilevel power addressing (MPA), the sequence for N time intervals SF in one frame period may be e.g. SF1(V1), SF1(V2), SF1(V3) . . . SF1(Vn); SF2(V1) . . . SF2(Vn); . . . ; SFN(V1) . . . SFN(Vn). This is an example of the intermixed mode, wherein the emission state of the LED is varied repeatedly.

Figure 6:
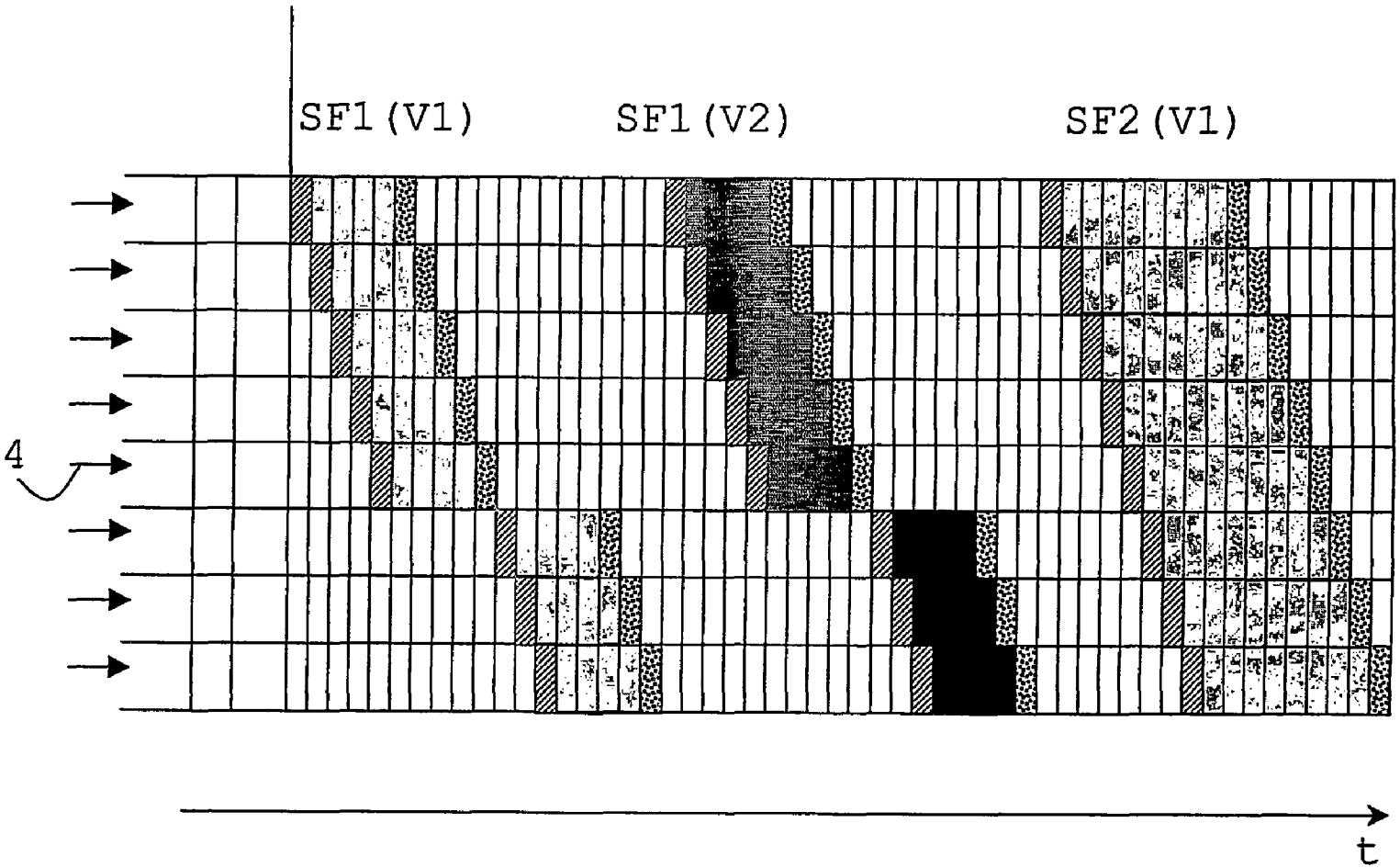
FIG. 6 shows a schematical timing diagram representing pulse width modulation employing multilevel power addressing (MPA) for the embodiment shown in FIG. 5.

In the MPA-approach the individual time intervals SF are in fact used n times instead of only once. As a result the number of bits for gray scale levels is best enhanced by a factor of n. FIG. 6 displays a timing diagram for a display 2 of eight rows 4, wherein during SF1 first a first emission state V1 (light gray blocks) is employed for the display pixels 3, followed by a second emission state V2 (black blocks) during a subsequent identical time interval SF1.

Figure 7:
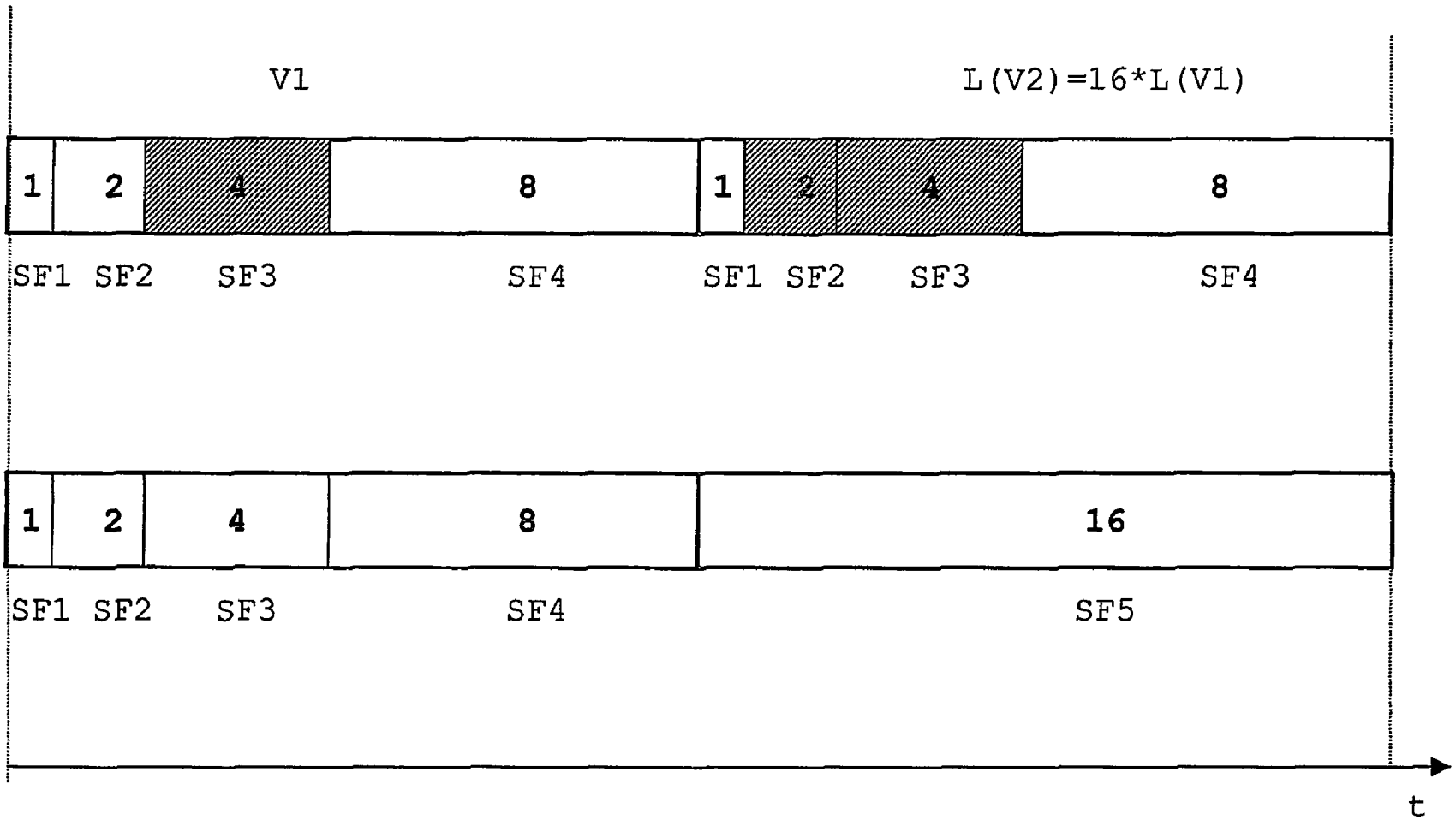
FIG. 7 shows a conceptual timing diagram of a second embodiment of the invention, employing multilevel power addressing (MPA) in the sequential mode.

In FIG. 7 a conceptual timing diagram employing MPA in a sequential mode is displayed for a 16 gray scale level (=4 bit) PWM addressing scheme in a single row 4. In the sequential mode, first all time intervals SF for a first emission state V1 are supplied over the selection line 12 followed by all time intervals SF for a second emission state V2. It is noted once more that the time intervals SF are not necessarily ordered according to the time duration but may be mixed up if this provides for more efficient usage of the frame period. In FIG. 7 the numbers indicate the number of gray scale levels associated with the time intervals SF1 . . . SF4. The second emission state V2 is chosen such that the light emission level L(V2) of the display pixel 3 in the second emission state V2 is equal to the number of gray scale levels in the frame period, i.e. 16, times the light emission level L(V1) of the light emitting elements in the first emission state. In the upper timing diagram MPA is employed in the sequential mode. In order to achieve e.g. gray scale level 100, it is sufficient to provide the hatched bits over the selection line 12 to the display pixel 3 in a frame period. The maximum number of gray levels is 256 in one frame period. For the sake of comparison the lower timing diagram displays the situation without MPA. In this case the same amount of time allows only 32 gray scale levels in one frame period. More generally, if n power levels are available over power line 14, i.e. multilevel power addressing (MPA), the sequence for N time intervals in one frame period for the sequential mode is SF1(V1), SF2(V1), SF3(V1) . . . SFN(V1); SF(V2) . . . SFN(V2); . . . ; SF1(Vn) . . . SFN(Vn).

Figure 8:
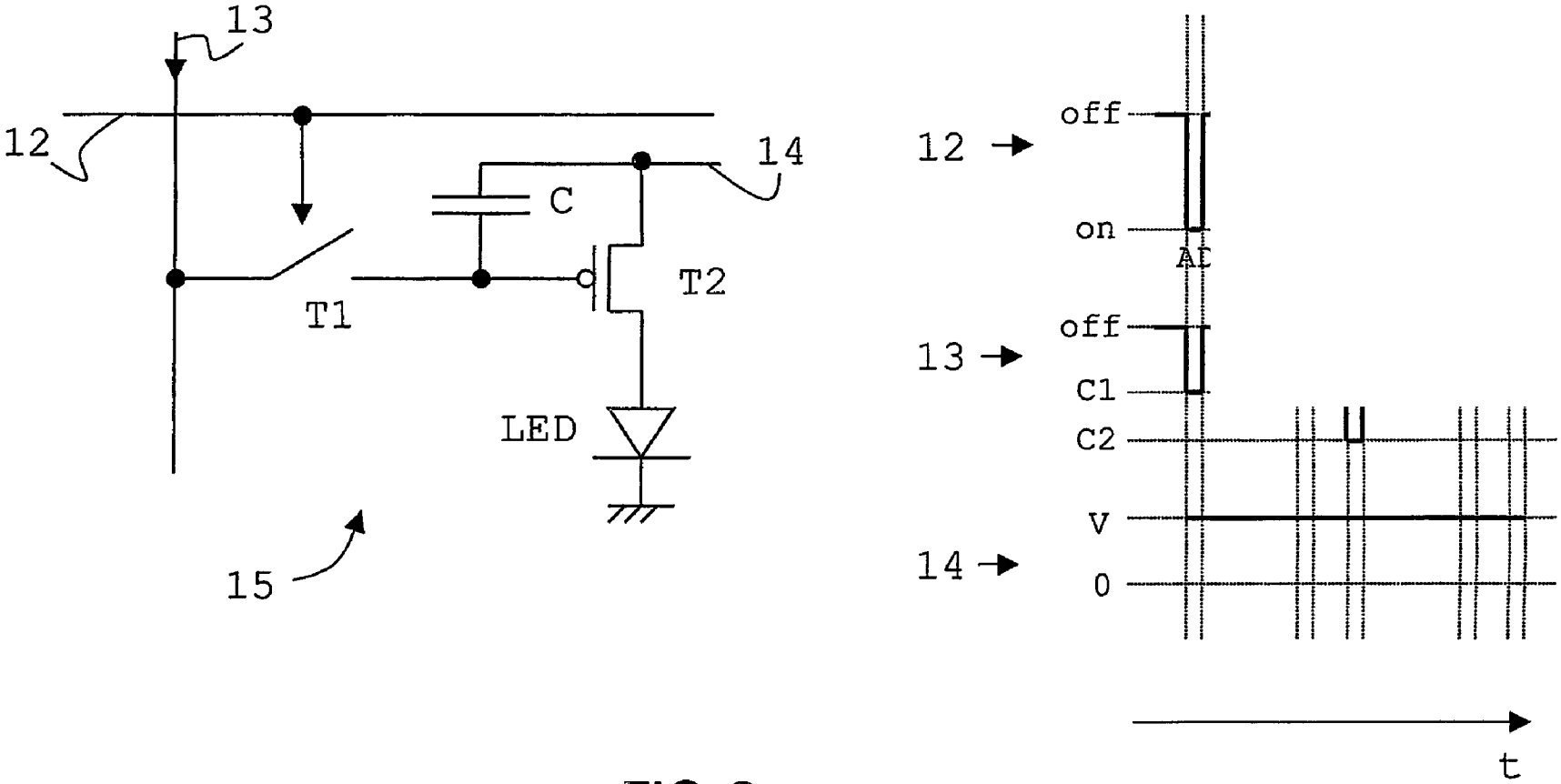
FIG. 8 shows a third embodiment of the invention in a voltage programmed pixel circuit, employing multilevel column addressing (MCA) in the intermixed mode.

FIG. 8 shows a third embodiment of the invention in a voltage programmed pixel circuit 15, employing multilevel column addressing (MCA) in the intermixed mode. Selection signals are again applied over the selection line 12 as shown in the right-hand diagram. In this embodiment changing the column voltage over the data lines 13, shown in the right-hand diagram, creates the additional gray scale levels. The power level, supplied over the power line 14, for the display pixels 3 is kept constant. It is noted however that MPA and MCA can be employed both in one addressing scheme. In this embodiment a semi-digital approach is taken, wherein a limited amount of voltage levels can be applied to the gate of transistor T2 including the voltage level for switching off T2. T2 thus no longer just functions as a switch, as was the case in FIG. 5, but is a semi-analog component such that the LED is current driven at data level C1, whilst it may still act as a switch at data level C2. It is noted that this state is beneficial from the perspective of degradation of the LED, since with the currently used polymer materials the lifetime of voltage driven LEDs is shorter.

Figure 9:
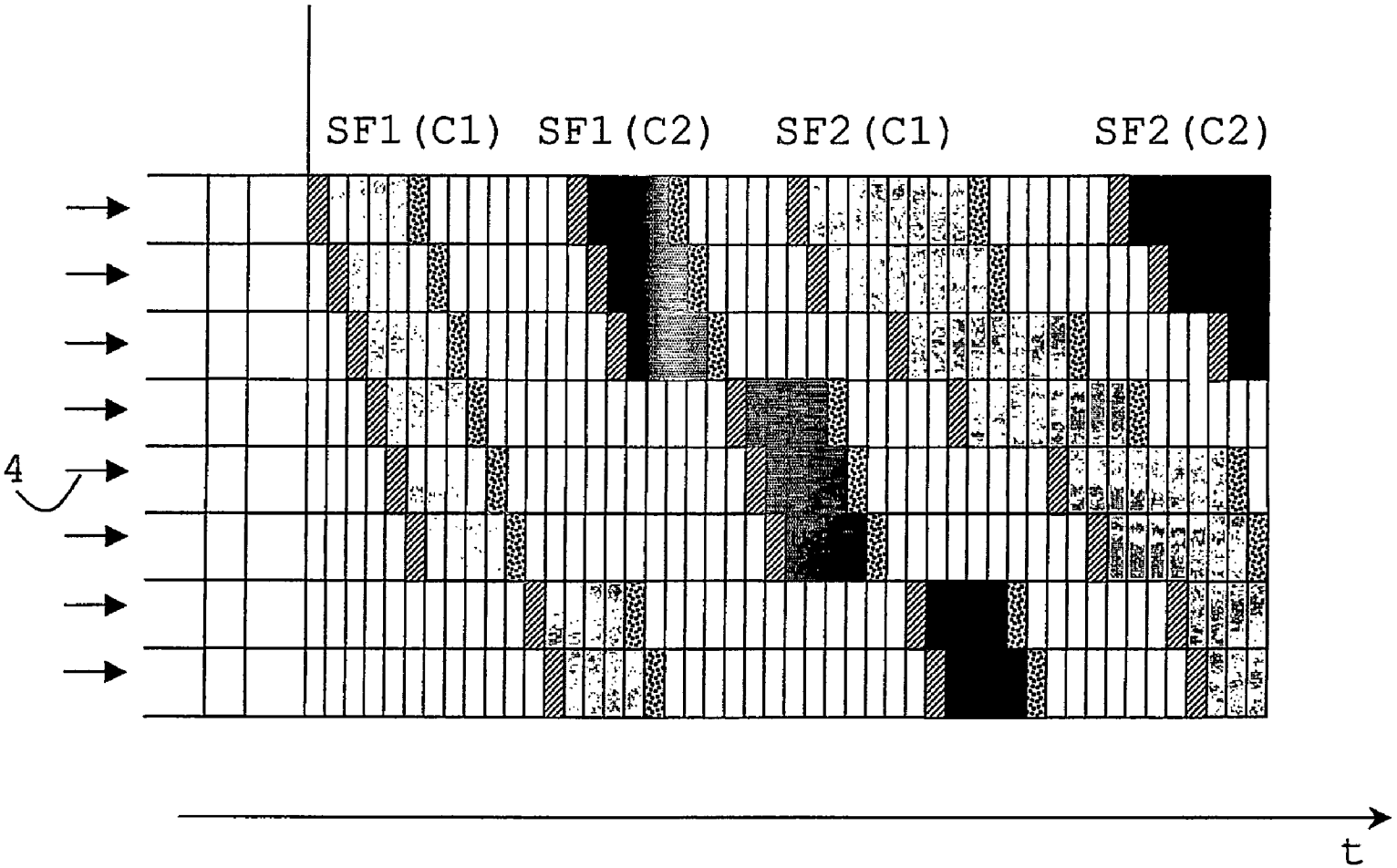
FIG. 9 shows a schematical timing diagram representing pulse width modulation employing multilevel column addressing (MCA) for the embodiment shown in FIG. 8.

The light emission states of the LED are determined by the number of voltages that are applied to the gate of T2 over data lines 13. As in FIG. 5, in FIG. 8 a preferred embodiment doubles the number of gray scale levels by providing over the data line 13 a first emission state associated with C1 and a second emission state associated with C2 for the display pixel 3 for each time interval SF. The levels C1 and C2 are preferably chosen such that the light emission level L(C2) of the LED at state C2 equals the number of gray scale levels times the light emission level L(C1) at state C1. If e.g. the PWM is 4 bits (16 gray scale levels), applying multilevel column addressing (MCA) yields 256 gray scale levels. In general if n voltage levels are available over the data lines 13, i.e. multilevel column addressing (MCA), the sequence for N time intervals in one frame period may be e.g. SF1(C1), SF1(C2), SF1(C3) . . . SF1(Cn); SF2(C1) . . . SF2(Cn); . . . ; SFN (CL) . . . SFN(Cn) for the intermixed mode. FIG. 9 shows the timing diagram employing a PWM-MLA-MCA addressing scheme. The light gray blocks represent the first emission state C1, while the black blocks represent the second emission state C2.

Like FIG. 5, FIG. 8 can also be employed in a sequential mode, resulting in a general case in the sequence SF1(C1), SF2(C1), SF3(C1) . . . SFN(C1); SF1(C2) . . . SFN(C2); . . . SF1(Cn) . . . SFN(Cn).

Figure 10:
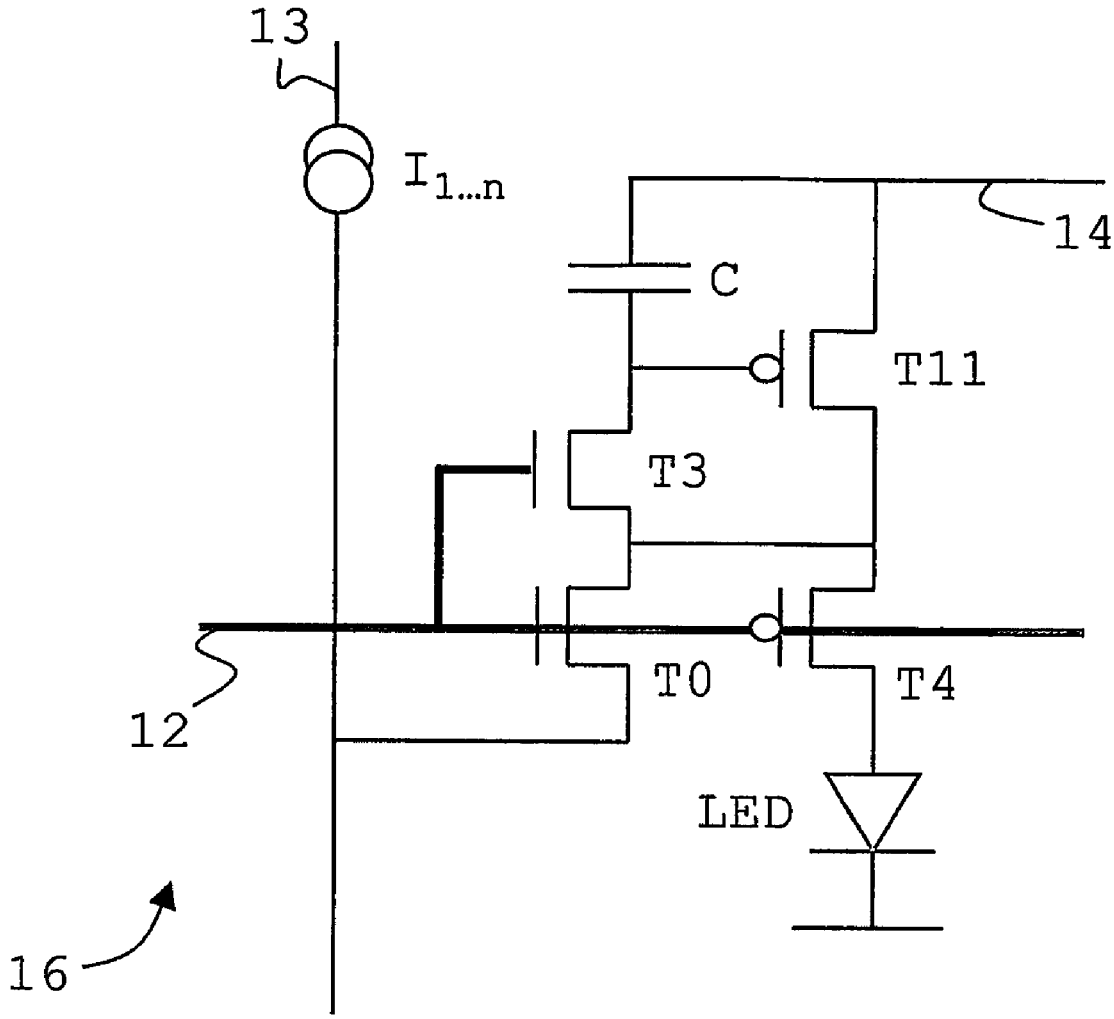
FIG. 10 shows a fourth embodiment of the invention in a current programmed pixel circuit.

Multiple column addressing (CA) schemes can also be employed in current programmable pixel circuits. FIG. 10 shows a known current programmed pixel circuit 16 having a switched current mirror circuit. The current mirror may also be operated using other types of current mirror circuits. The data line 13 can be used to provide n current levels $I_1 \ldots I_n$ to activate the LED to n different emission states in the frame period. The zero level can either be a voltage level, which is preferred for higher speeds, or a current level to deactivate the LED during addressing or erasing. During addressing or erasing the switch transistors T0 and T3 are on, switch transistor T4 is off and driving transistor T11 is programmed to drive the current $I_i$. In the burning period, T0 and T3 are switched off, T4 is turned on and T11 delivers the current $I_i$ to the LED.

In a preferred embodiment n=2, i.e. a current $I_1$ is associated with a first emission state and a current $I_2$ is associated with a second emission state of the display pixel. Current $I_2$ is preferably such that the light emission level $L(I_2)$ in the second emission state equals the light emission level $L(I_1)$ in the first emission state times the number of gray scale levels for the first emission state. A circuit according to FIG. 10 preferably is operated in the sequential mode, thereby yielding the sequence SF1($I_1$), SF2($I_1$), SF3($I_1$) . . . SFN($I_1$); SF1($I_2$) . . . SFN($I_2$); . . . ; SF1($I_n$) . . . SFN($I_n$). The embodiment shown in FIG. 10 is less suitable for the intermixed mode since the current source is normally not capable of switching quickly between precise current levels.

Figure 11:
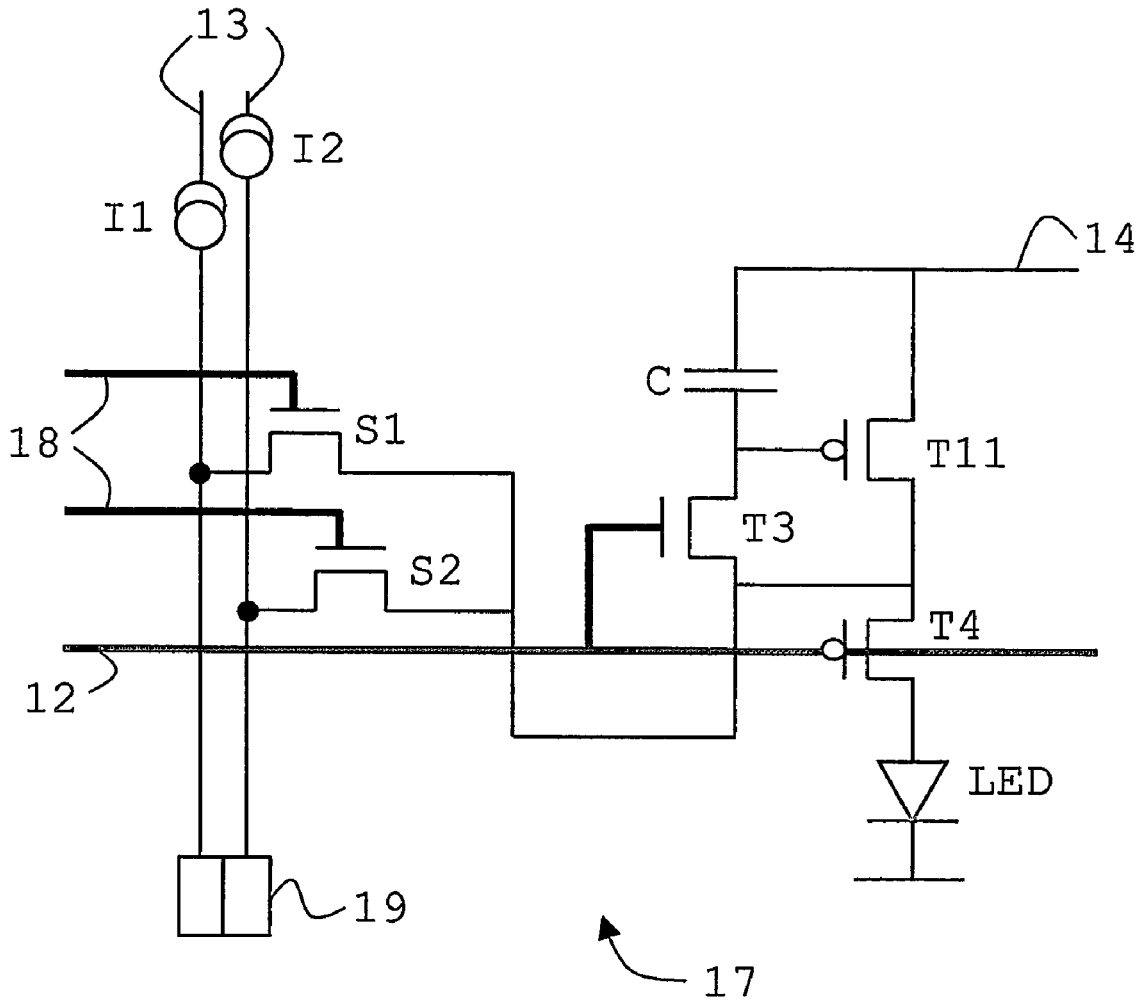
FIG. 11 shows a fifth embodiment of the invention in a modified current programmed pixel circuit. The same reference numbers in different Figs. refer to the same elements.

To enable the intermixed mode in employing MCA schemes for current programmable pixel circuits it is preferred to use several independent current sources providing a suitable current magnitude over the data line 13. In FIG. 11 such a modified current programmable pixel circuit 17 is shown, having two independent current sources providing currents I1 and I2 over the data lines 13. Switch transistors S1 and S2, controlled by the control unit 10 over lines 18, are adapted to supply current I1 and I2, respectively, in the appropriate time interval SF. The other current may be dumped in a dumping unit 19. For a 4-bit PWM addressing scheme in the intermixed mode the scheme may read SF3(I1), SF3(I2), SF2(I1), SF2(I2), SF4(I1), SF4(I2), SF1(I1), SF1(I2). Note that in this sequence the time intervals are mixed up with respect to their duration, which may be preferred for efficient usage of the frame period.

Current programmable pixel circuits 16, 17 are known to suffer from timing problems due to parasitic coupling. When a current pulse is written to a display pixel 3, the parasitic capacitance of the data lines 13 corresponding to the column 5 of display pixels 3 is to be charged first. This capacitance may be of a significantly high level and is dependent on the size of the display 2. The current programmable pixels circuits 16, 17 shown in FIGS. 10 and 11 may therefore be suited for pre-charging the data lines 13, i.e. bringing the data lines 13 to a suitable voltage before supplying the current. This pre-charging can be managed by the data driver 8 via the control unit 10.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, a number of these means may be embodied by one and the same item of hardware. The mere fact that certain measures are recited in mutually different dependent claims does not indicate that a combination of these measures cannot be used to advantage.

The invention claimed is:

1. A display device comprising:

a display with a plurality of light emitting elements, and data lines for providing pulse width modulation signals to the light emitting elements; and generating means coupled to the data lines for generating, during time intervals of a frame period, at least a first non-zero emission level during a first one of the time intervals and a second non-zero emission level during a second one of the time intervals, for reordering the time intervals non-sequentially within the frame period including the first and second time intervals in an order that reduces dead times between the time intervals, and for applying the first and second non-zero emission levels to a light emitting element in a time sequence determined by the reordered time intervals.

2. The display device according to claim 1, wherein the display further comprises selection lines, each selection line being coupled to a part of the plurality of light emitting elements, the generating means being further coupled to the selection lines for applying a multiline addressing scheme to the data lines and the selection lines.

3. The display device according to claim 1, wherein the generating means are adapted to generate time intervals of a substantially binary weighted duration wherein each of the time intervals is assigned the substantially binary weighted duration regardless of emission levels during each of the time intervals.

4. The display device according to claim 1, wherein the generating means are adapted to generate time intervals of a substantially binary weighted duration regardless of an ordering of the time intervals.

5. The display device according to claim 1, wherein the generating means are adapted to generate the first and second emission level via the data lines in an intermixed mode.

6. The display device according to claim 3, wherein the generating means comprise a control unit, and a data driver comprising a first current source for generating the first emission level and a second current source for generating the second emission level.

7. The display device according to claim 5, wherein the generating means are adapted to pre-charge the data lines before coupling one of the current sources to one of the data lines.

8. The display device according to claim 1, further comprising a power line for coupling a first supply voltage to the plurality of light emitting elements for generating the first emission level and a second supply voltage for generating the second emission level, respectively.

9. The display device according to claim 1, wherein the generating means are adapted to generate the second emission level at a level substantially equal to the first emission level multiplied by a number of selectable combinations of time intervals.

10. Electric device comprising a display device according to claim 1.

11. A method for driving a display device comprising a display with a plurality of light emitting elements and data lines coupled to the light emitting elements, the method comprising the steps of:

providing pulse width modulation signals to the data lines;

generating in synchronization with the pulse width modulation signals, during time intervals of a frame period, at least a first non-zero emission level during a first one of the time intervals and a second non-zero emission level during a second one of the time intervals;

reordering the time intervals non-sequentially within the frame period including the first and second time intervals in an order that reduces dead times between the time intervals; and applying the first and second non-zero emission levels to a light emitting element in a time sequence determined by the reordered time intervals.

12. A display device comprising:

a display with a plurality of light emitting elements, and data lines for providing pulse width modulation signals to the light emitting elements; and a controller configured to generate, during time intervals of a frame period, at least a first non-zero emission level during a first one of the time intervals and a second non-zero emission level during a second one of the time intervals, wherein the controller is configured to reorder the time intervals non-sequentially within the frame period including the first and second time intervals in an order that reduces dead times between the time intervals and is configured to apply the first and second non-zero emission levels to a light emitting element in a time sequence determined by the reordered time intervals.

13. The display device according to claim 12, wherein the controller is configured to generate time intervals of a substantially binary weighted duration, wherein each of the time intervals is assigned the substantially binary weighted duration regardless of emission levels during each of the time intervals.

14. The display device according to claim 12, wherein the controller is configured to generate time intervals of a substantially binary weighted duration regardless of an ordering of the time intervals.

* * * * *